US007381247B2

(12) United States Patent
Han et al.

(10) Patent No.: US 7,381,247 B2
(45) Date of Patent: Jun. 3, 2008

(54) CYCLONE DUST COLLECTING DEVICE FOR VACUUM CLEANER

(75) Inventors: Jung-gyun Han, Gwangju (KR); Jang-keun Oh, Gwangju (KR); Min-ha Kim, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 202 days.

(21) Appl. No.: 11/356,704

(22) Filed: Feb. 17, 2006

(65) Prior Publication Data

US 2006/0278081 A1 Dec. 14, 2006

(30) Foreign Application Priority Data

Jun. 14, 2005 (KR) ..... 10-2005-0050897

(51) Int. Cl.
*B03C 3/15* (2006.01)

(52) U.S. Cl. ..... 96/61; 15/353; 55/DIG. 3; 96/97; 96/98

(58) Field of Classification Search ..... 96/60–62, 96/95–100; 95/78; 55/DIG. 3, DIG. 38; 15/353

See application file for complete search history.

(56) References Cited

U.S. PATENT DOCUMENTS 4,010,011 A * 3/1977 Reif ..... 96/61
4,066,526 A * 1/1978 Yeh ..... 204/554
4,309,199 A * 1/1982 Suzuki ..... 96/18
4,352,681 A * 10/1982 Dietz ..... 96/61
4,390,426 A * 6/1983 Vicard ..... 210/243
4,649,703 A * 3/1987 Dettling et al. ..... 60/275
4,689,951 A * 9/1987 Polach ..... 60/275
5,683,494 A * 11/1997 Altman et al. ..... 96/55
5,888,276 A * 3/1999 Price et al. ..... 96/17
5,968,231 A * 10/1999 Parmentier et al. ..... 95/28
6,071,330 A 6/2000 Matsubara et al. ..... 96/69
6,228,148 B1 * 5/2001 Aaltonen et al. ..... 95/74
6,383,266 B1 5/2002 Conrad et al. ..... 96/57
2005/0028675 A1 2/2005 Conrad et al. ..... 96/57

FOREIGN PATENT DOCUMENTS

CN 2289511 Y 9/1998
DE 3121935 A1 6/1982
DE 3723153 A1 1/1989

(Continued)

OTHER PUBLICATIONS

Official action issued Jun. 26, 2007 with reference to Russian Patent Application No. 2006113425.

(Continued)

*Primary Examiner*—Richard L Chiesa
(74) *Attorney, Agent, or Firm*—Ohlandt, Greeley, Ruggiero & Perle, LLP.

(57) ABSTRACT

A cyclone dust collecting device using a corona discharge is provided. The cyclone dust collecting device includes a cyclone chamber rotating air drawn in from the outside to separate contaminants from the air, a discharge pipe guiding the air separated from the contaminants to the outside of the cyclone chamber and including a discharge electrode part with at least a part made of a conductive material and a power supply unit supplying a power to the discharge electrode part for the discharge electrode part to perform a corona discharge.

10 Claims, 5 Drawing Sheets

FOREIGN PATENT DOCUMENTS

| | | | |
|---|---|---|---|
| DE | 2004028675 | A1 | 4/2005 |
| FR | 2654648 | | 5/1991 |
| FR | 2859372 | | 3/2005 |
| JP | 57-045356 | | 3/1982 |
| KR | 20030010157 | A | 2/2003 |
| RU | 1835671 | | 9/1996 |
| SU | 446313 | | 12/1974 |
| SU | 971475 | | 11/1982 |

OTHER PUBLICATIONS

Examiner's report dated Aug. 7, 2007 corresponding to Australian Patent Application No. 2006201525.
Search Report dated Oct. 25, 2007 corresponding to European Patent Application No. 06290594.8.

* cited by examiner

CYCLONE DUST COLLECTING DEVICE FOR VACUUM CLEANER

CROSS-REFERENCE TO RELATED APPLICATIONS

This application claims the benefit under 35 U.S.C. § 119 (a) of Korean Patent Application No. 2005-50897 filed on Jun. 14, 2005, the entire content of which is incorporated herein by reference.

BACKGROUND OF THE INVENTION

1. Field of the Invention

The present invention relates to a vacuum cleaner. More particularly, the present invention relates to a cyclone dust collecting device for a vacuum cleaner, which separates contaminant from drawn-in air by using a cyclone dust collecting system.

2. Description of the Related Art

When a suction motor is driven, a vacuum cleaner draws in contaminant-laden air via a suction assembly from a surface and separates contaminants from the drawn-in air so as to clean the surface. To separate the contaminants, a dust collecting device is employed. Recently, a cyclone dust collecting device has been popularized which separates contaminants from drawn-in air by using a centrifugal force generated by rotating the drawn-in air.

The conventional cyclone dust collecting device is more convenient to use and more sanitary when compared to a dust bag; however, it has a poor separation efficiency of fine contaminants in the drawn-in air. To solve this problem, a cyclone dust collecting device with an improved separation efficiency of fine contaminants has been developed by generating a corona discharge in a cyclone dust collecting device and ionizing fine contaminants so that the ionized fine contaminants are electromagnetically separated from the drawn-in air. The conventional cyclone dust collecting device using the corona discharge generally has a separate discharge electrode part of a needle shape in a cyclone chamber. However, the discharge electrode part may be damaged due to the movement of air and contaminant in the cyclone dust collecting device so that the durability of the vacuum cleaner decreases and safety of a user cannot be guaranteed. Additionally, the amount of electric charge varies in a radial direction or an axial direction around the discharge electrode part, which limits the fine contaminant collection efficiency.

SUMMARY OF THE INVENTION

The present invention has been conceived to solve the above-mentioned problems occurring in the prior art, and an object of the present invention is to provide a highly durable cyclone dust collecting device, which uses a corona discharge to improve separation efficiency of fine contaminants.

Another object of the present invention is to provide a cyclone dust collecting device, which regularly distributes an average amount of electric charge around a discharge electrode so as to increase the dust collection efficiency.

In order to achieve the above objects, there is provided a cyclone dust collecting device including a cyclone body rotating drawn-in air from outside the cyclone body and separating contaminants from the air, a discharge pipe guiding the air separated from the contaminants to the outside of the cyclone body and including a discharge electrode part with at least a part made of a conductive material, and a power supply unit supplying a power to the discharge electrode part for the discharge electrode part to generate a corona discharge. Accordingly, due to the stable discharge electrode part, the durability increases and the average amount of electric charge is regularly distributed so that the fine contaminant separation efficiency increases.

The discharge pipe may be entirely made of a conductive material so as to form the discharge electrode part. The discharge pipe further includes at least one discharge protrusion integrally formed with the discharge electrode part, and the at least one discharge protrusion may be configured as a cone with a sharp end.

The discharge electrode part may include a discharge part and a connection part, and the connection part may be connected with the power supply unit to receive the power. The connection part may be configured as a pipe to enclose an inner surface of the discharge pipe. The discharge part may be integrally formed with the connection part.

The discharge electrode part may have opposite ends connected with the inner surface of the discharge pipe to go through an inside of the discharge pipe and include at least one discharge protrusion. The discharge electrode part may be configured as a beam.

The cyclone dust collecting device may further include a fine contaminant collection part made of a conductive material and formed on an inner surface of the cyclone chamber to collect a fine contaminant ionized by the corona discharge. The fine contaminant collection part may include a conductive paint sprayed on an inner surface of the cyclone chamber.

The cyclone dust collecting device may include a cyclone body having a first cyclone chamber at a central portion and at least one second cyclone chamber enclosing an outside of the first cyclone chamber, a contaminant receptacle detachably engaged with a bottom end of the cyclone body to receive the contaminant discharged from the cyclone chambers, a connection path guiding the air discharged from the first cyclone chamber into the at least one second cyclone chamber, and a cover part covering an opened top end of the cyclone body to form a discharge path guiding the air discharged from the at least one second cyclone chambers to an outside of the cyclone body. The discharge electrode part may be disposed in the second cyclone chamber.

The fine contaminant collection part may be formed over inner surfaces of the second cyclone chamber and the cover part.

The device may further include a discharge opening guiding the air discharged from the first cyclone chamber to the connection path, and a discharge needle having a top end connected with the power supply unit and a bottom end penetrating the discharge opening and disposed in the first cyclone chamber.

The device may further include a grille assembly disposed at the discharge opening to enclose the discharge needle. The fine contaminant collection part is also formed on inner surfaces of the connection path and the first cyclone chamber.

BRIEF DESCRIPTION OF THE DRAWINGS

The above and other aspects, features and advantages of the present invention will become more apparent and more readily appreciated from the following detailed description of the embodiment taken with reference to the accompanying drawings of which.

DETAILED DESCRIPTION OF THE INVENTION

Figure 1:
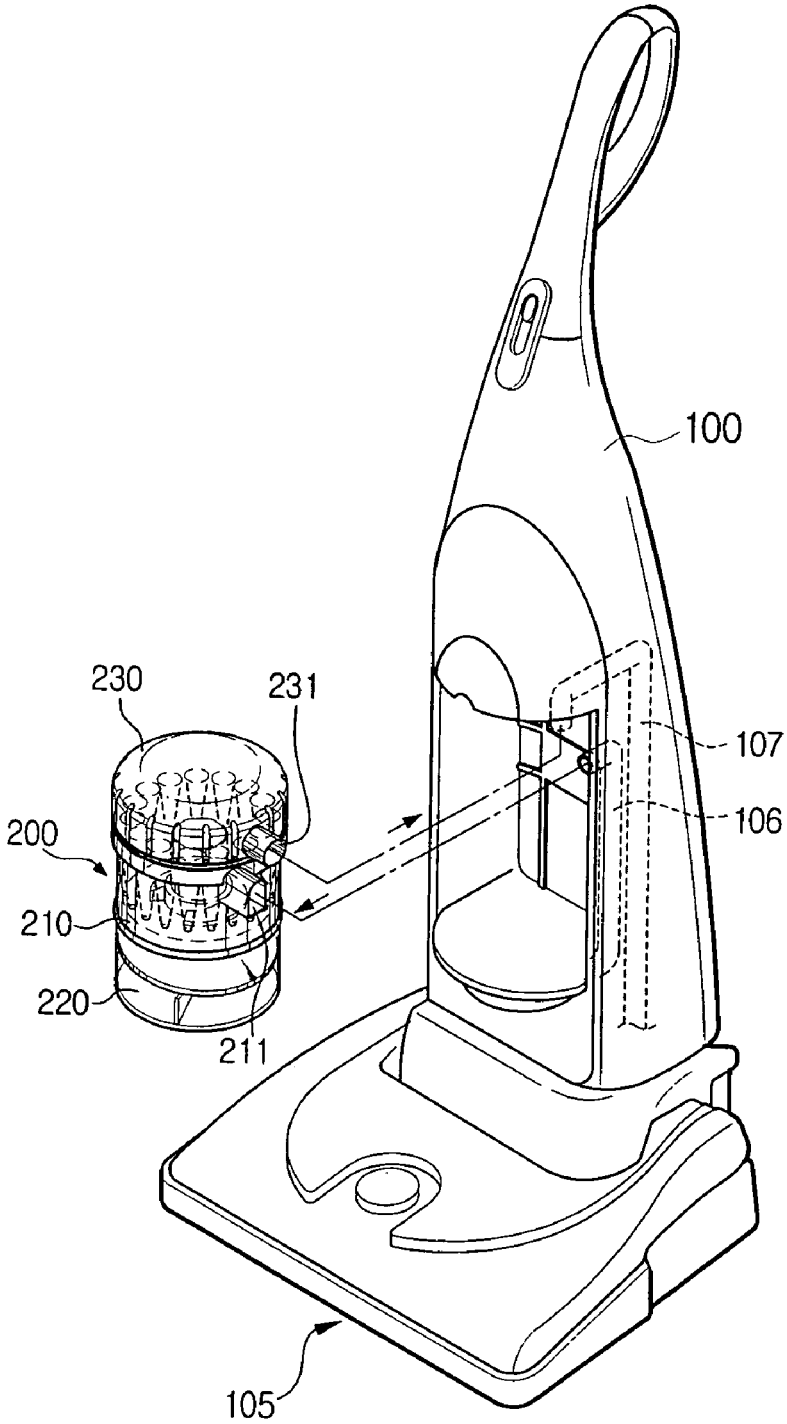
FIG. 1 is a view of a vacuum cleaner employing a cyclone dust collecting device according to an embodiment of the present invention.

Exemplary embodiments of the present invention will be described in detail with reference to the annexed drawings. In the drawings, the same elements are denoted by the same reference numerals throughout. In the following description, detailed descriptions of known functions and configurations incorporated herein have been omitted for conciseness and clarity.

Figure 2:
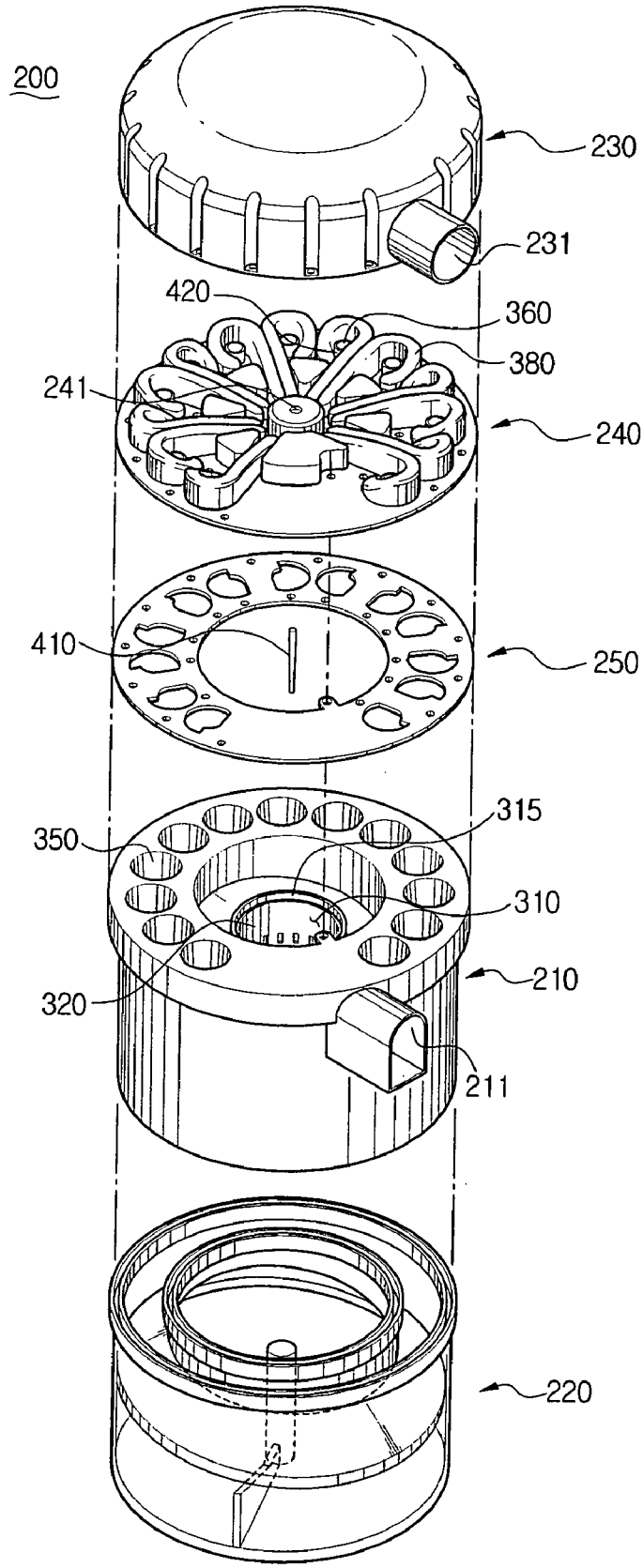
FIG. 2 is an exploded perspective view of a cyclone dust collecting device according to an embodiment of the present invention.

Referring to FIGS. 1 and 2, a dust collecting device 200 according to the first embodiment of the present invention is mounted into a cleaner body 100 to connect with an air suction duct 106 and an air discharge duct 107. As air is drawn in via a suction assembly 105, the air flows first through the air suction duct 106 and then through an air inlet pipe 211, and into the cyclone dust collecting device 200. The cyclone dust collecting device 200 separates contaminants from the air and discharges the air from an air outlet 231 to the air discharge duct 107 and to the outside of the cleaner body 100.

The cyclone dust collecting device 200 comprises a cyclone body 210, a contaminant receptacle 220, a cover part 230, and an intermediate cover 240. A gasket 250 is disposed between the intermediate cover 240 and the cyclone body 210 to prevent a leakage of air.

Figure 3:
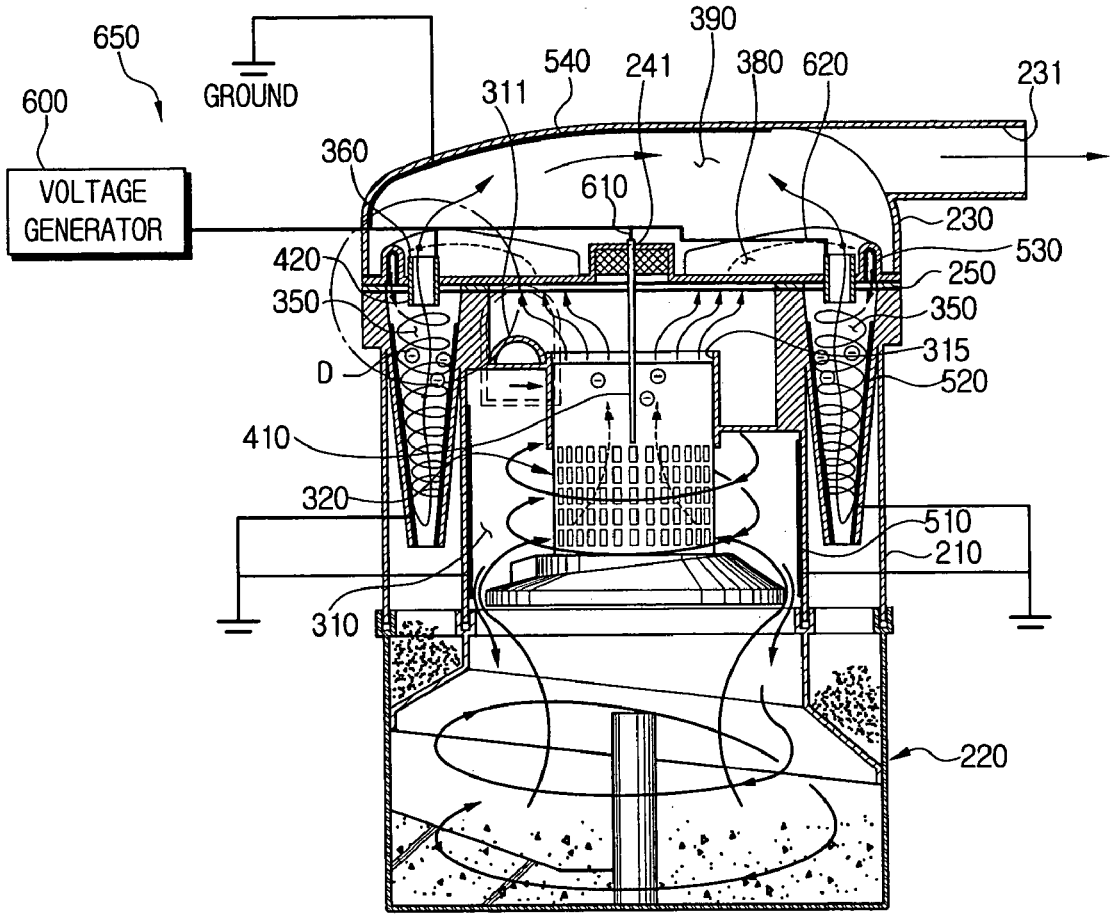
FIG. 3 is a view of an example of a cyclone dust collecting device according to the first embodiment of the present invention.

Referring to FIGS. 2 and 3, the cyclone body 210 according to the first embodiment of the present invention comprises a first cyclone chamber 310 and a plurality of second cyclone chambers 350. The first cyclone chamber 310 is formed in a central portion of the cyclone body 210 with opened top and bottom portions. The first cyclone chamber 310 is connected with the air inlet pipe 211 and a central air discharge opening 315. The air inlet pipe 211 penetrates a side of the cyclone body 210. The air flows in via the air inlet pipe 211 into the first cyclone chamber 310, where the air is rotated so that contaminants are separated by inertia. The air removed of contaminants flows via a grille member 320, the central discharge opening 315 and connection paths 380 into the second cyclone chambers 350. The plurality of the second cyclone chambers 350 are penetratingly formed in the cyclone body 210 to enclose the outside of the first cyclone chamber 310. Top portions of the second cyclone chambers 350 are connected with discharge pipes 360 and the connection paths 380 formed at the intermediate cover 240. Therefore, the air flowing via the connection paths 380 into the second cyclone chambers 350 is rotated in the second cyclone chambers 350. While rotating, the air is separated from fine contaminants and then discharged via the discharge pipes 360, a discharge path 390 and the air outlet 231 to the outside of the cyclone dust collecting device 200.

The cyclone dust collecting device 200 according to the first embodiment of the present invention comprises a discharge needle 410, a discharge electrode part 420, a first, second, third, and fourth fine contaminant collection part 510, 520, 530, and 540, respectively, and a power supply unit 650 to increase the separation efficiency of fine contaminants by using a corona discharge. The power supply unit 650 comprise a voltage generator 600 generating a high voltage and a first and a second conductive wire 610, 620 connecting the voltage generator 600 with the discharge needle 410 and the discharge electrode part 420, respectively.

The voltage generator 600 is installed in the cleaner body 100 (refer to FIG. 1) to generate power to be supplied to both the discharge needle 410 and the discharge electrode part 420 by using the power applied to the cleaner body 100.

Figure 4:
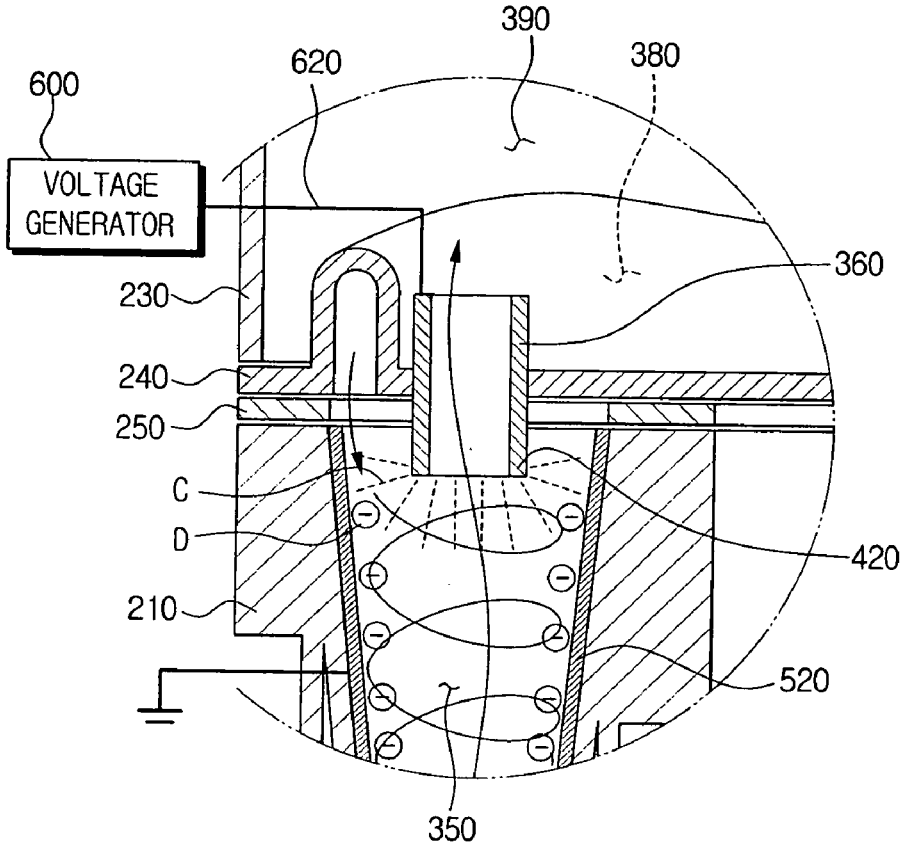
FIG. 4 is a view of an example of an important portion of the cyclone dust collecting device according to the first embodiment of the present invention.

The discharge needle 410 and the discharge electrode part 420 generate a corona discharge in the first and the second cyclone chambers 310, 350 so that fine contaminants included in the air of the first and the second cyclone chambers 310, 350 are ionized to have a negative (−) electric charge. The discharge needle 410 is provided in the first cyclone chamber 310 such that the top end thereof penetrates a penetrating opening 241 (refer to FIG. 2) of the intermediate cover 240 to be exposed to the discharge path 390 and the bottom end thereof penetrates the central air discharge opening 315 to be disposed in the grille member 320. The top end of the discharge needle 410 exposed to the discharge path 390 is connected via the first conductive wire 610 with the voltage generator 600 so as to receive the power for the corona discharge. The discharge electrode part 420 is provided in the second cyclone chambers 350. As shown in FIGS. 3 and 4, the discharge pipes 360 guiding the air discharged from the second cyclone chambers 350, are made of conductive material so that terminal ends of the discharge pipes 360 disposed in the second cyclone chambers 350 perform functions of the discharge electrode part 420. Accordingly, the top ends of the discharge pipes 360 are connected via the second conductive wire 620 with the voltage generator 600 to transmit power to the discharge electrode part 420. Accordingly, the average amount of electric charge is regularly distributed so that the dust collection efficiency increases and stable operation can be guaranteed under a fast flow speed.

The first and the second fine contaminant collection parts 510, 520 are formed in a grounded condition on inner surfaces of the first and the second cyclone chambers 310, 350. The third and the fourth fine contaminant collection parts 530, 540 are formed in a grounded condition on inner surfaces of the connection paths 380 and the cover part 230. Accordingly, after being ionized by the discharge needle 410, fine contaminants D are collected by the first and the third fine contaminant collection parts 510, 530 while flowing toward the second cyclone chambers 350. The fine contaminants D that are not collected by the first and the third fine contaminant collection parts 510, 530 flow into the second cyclone chambers 350, are re-ionized by the discharge electrode part 420 and then collected by the second and the fourth fine contaminant collection parts 520, 540. The fine contaminant collection parts 510, 520, 530, 540 can collect the fine contaminants D by using the electromagnetic force only if the fine contaminant collection parts are made of conductive material and rightly grounded. The fine contaminant collection parts 510, 520, 530, 540 according to the present embodiment are formed by spraying a conductive paint over the first cyclone chamber 310, the second cyclone chambers 350, the intermediate cover 240 forming the connection paths 380, and the cover part 230 forming the discharge path 390. Therefore, the fine contaminant collection parts 510, 520, 530, 540 do not require the cyclone dust collecting device 200 to have a complicated structure. However, a member of conductive material may be separately formed.

The method for separating fine contaminants by using the discharge needle 410, the discharge electrode part 420 and the fine contaminant collection parts 510 through 540 will be explained with reference to FIG. 4. As the air flows via the connection paths 380 into the second cyclone chambers 350, the air is rotated in the second cyclone chambers 350 to separate the contaminants by centrifugal force. Around the discharge electrode part 420, a corona discharge C is generated by the power applied from the voltage generator 600 to the discharge electrode part 420. Due to the corona discharge C, the fine contaminants D included in the air are negatively (−) ionized. As the fine dusts D are negatively ionized as described above, the grounded second fine contaminant collection part 520 formed on the inner surface of the second cyclone chambers 350 performs the same effect as being positively (+) charged so as to attract negatively ionized fine contaminants D. Therefore, the negatively ionized fine contaminants D are not discharged via the discharge pipes 360 to the outside of the second cyclone chambers 350 but collected on the second fine contaminant collection part 520 sprayed on the inner surface of the second cyclone chambers 350. Ionized fine contaminants D that are discharged via the discharge pipes 360 to the outside of the second cyclone chambers 350 without being collected on the inner surface of the second cyclone chambers 350, are collected on the fourth fine contaminant collection part 540 of the inner surface of the cover part 230 as shown in FIG. 3 so as to be prevented from being discharged to the outside of the cyclone dust collecting device 200. Therefore, the cyclone dust collecting device 200 has an increased separation efficiency of fine contaminants.

The discharge electrode part 420 can be implemented by various configurations. In case of the discharge needle 410, the needled-shaped configuration may be most preferable as shown in FIG. 3 because a part of the discharge needle 410 is disposed in the grille member 320. However, there is no limit to the configuration of the discharge electrode part 420 if the discharge electrode part 420 can be firmly supported by the discharge pipes 360. For example, the discharge electrode part 420 may be integrally formed with the discharge pipes 360.

Figure 5:
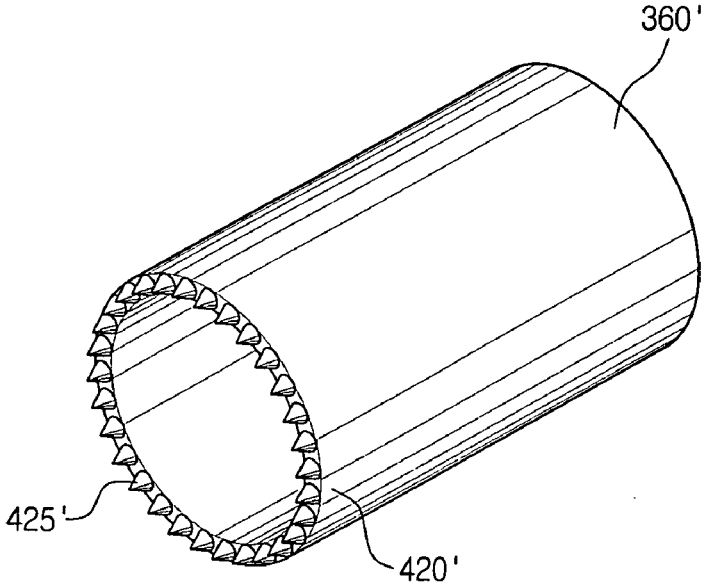
FIG. 5 is a perspective view of a discharge pipe according to the second embodiment of the present invention.

FIG. 5 is a view of a discharge electrode part 420' according to the second embodiment of the present invention. The discharge electrode part 420' is the same as the discharge electrode part 420 according to the first embodiment of the present invention in that an entire discharge pipe 360' is made of a conductive material. However, the discharge electrode part 420' can be distinguished from the discharge electrode part 420 according to the first embodiment of the present invention in that the discharge electrode part 420' includes one or more discharge protrusions 425', which are integrally formed with the discharge electrode part 420' to protrude toward the inside of the second cyclone chambers 350 (refer to FIG. 4). The discharge protrusions 425' are formed because the corona discharge can be more easily performed at a sharp portion. The discharge protrusions 425' may be formed in various configurations. However, to easily perform the corona discharge, it is preferable to form the discharge protrusions 425' with a sharp end and sides tapering to a point.

Figure 6:
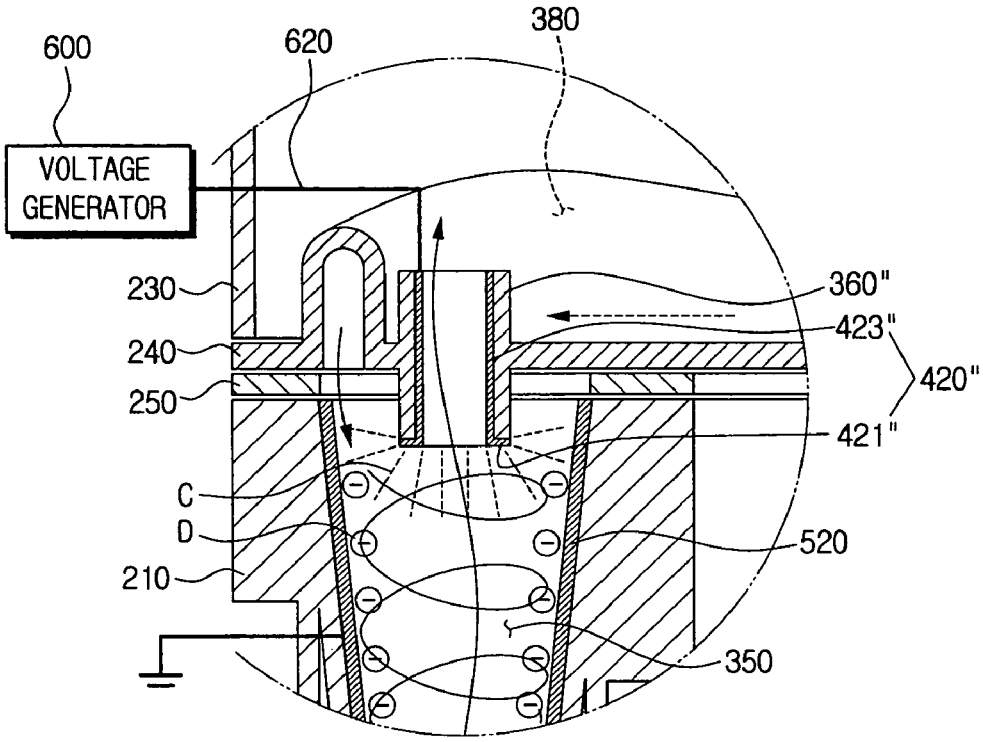
FIG. 6 is a view of an example of an important portion of the cyclone dust collecting device according to the third embodiment of the present invention.

FIG. 6 is a view of an example of a discharge electrode part 420" according to the third embodiment of the present invention. Referring to FIG. 6, the discharge electrode part 420" in the present embodiment comprises a connection part 423" inserted in discharge pipes 360" and a discharge part 421" exposed to a bottom end of the discharge pipes 360". The connection part 423" is configured as a pipe to enclose the inner surface of the discharge pipes 360". Therefore, although the intermediate cover 240 is made of synthetic resin material, the discharge electrode part 420" can be easily formed. In the present embodiment as the aforementioned second embodiment, a plurality of discharge protrusions 425' (refer to FIG. 5) may be protrusively formed integrally with the discharge electrode part 420". In this case, the corona discharge can be more effectively performed.

Figure 7:
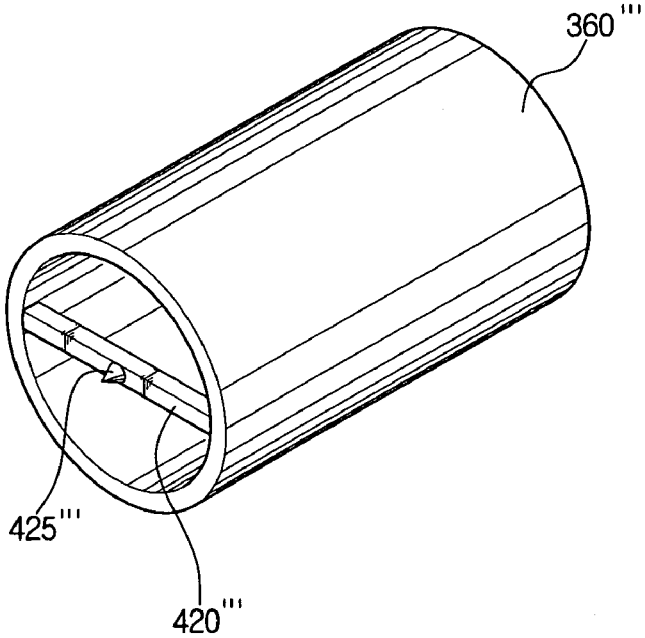
FIG. 7 is a perspective view of a discharge pipe according to the fourth embodiment of the present invention.

FIG. 7 is a view of a discharge electrode part 420''' according to the fourth embodiment of the present invention. Referring to FIG. 7, the discharge electrode part 420''' is made of a conductive material and configured as a beam. Opposite ends of the discharge electrode part 420''' are connected with the inner surface of the discharge pipes 360''' so as to go across the inside of the discharge pipes 360'''. The discharge electrode part 420''' and the discharge pipes 360''' may be made of the same material and integrally formed with each other. The discharge electrode part 420''' according to the present embodiment has a conical discharge protrusion 425''' protruding from the central portion. The operation of the discharge protrusion 425''' is the same as that of the discharge protrusions 425 of the second embodiment, and therefore, the detailed description thereof will be omitted.

The embodiments of the present invention has been explained by using an example in which a cyclone dust collecting device employing a plurality of cyclone chambers has a discharge electrode part. However, this should not be considered as limiting. The embodiments of the present invention may be applied to a cyclone dust collecting device employing a single cyclone chamber.

If the embodiments of the present invention are applied, the discharge electrode part can be easily formed, and more stably formed onto the discharge pipe. Therefore, even though air and/or contaminants are flowing in the cyclone chamber, damage to the discharge electrode part can be prevented.

The average amount of electric charge around the discharge electrode part is regularly distributed so that the collection efficiency of fine contaminants is increased.

Additional advantages, objects, and features of the embodiments of the invention will be set forth in part in the description which follows and in part will become apparent to those having ordinary skill in the art upon examination of the following, or may be learned from practice of the invention. The objects and advantages of the embodiments of the invention may be realized and attained as particularly pointed out in the appended claims.

What is claimed is:

1. A cyclone dust collecting device comprising:

a cyclone body rotating drawn-in air from an outside of the cyclone body to separate contaminants from the drawn-in air;

a discharge pipe guiding the drawn-in air separated from the contaminants to the outside of the cyclone body and including a discharge electrode part with at least a part made of a conductive material; and a power supply unit supplying a power to the discharge electrode part, wherein the discharge electrode part generates a corona discharge, and wherein the discharge electrode part has opposite ends connected with an inner surface of the discharge pipe to go across an inside of the discharge pipe and includes at least one discharge protrusion.

2. The device according to claim 1, further comprising at least one discharge protrusion integrally formed with the discharge electrode part.

3. The device according to claim 2, wherein the at least one discharge protrusion is configured as a cone with a sharp end.

4. The device according to claim 1, wherein the discharge electrode part is configured as a beam.

5. A cyclone dust collecting device comprising:

a cyclone body rotating drawn-in air from an outside of the cyclone body to separate contaminants from the drawn-in air;

a discharge pipe guiding the drawn-in air separated from the contaminants to the outside of the cyclone body and including a discharge electrode part with at least a part made of a conductive material;

a power supply unit supplying a power to the discharge electrode part, wherein the discharge electrode part generates a corona discharge; and a fine contaminant collection part made of a conductive material and formed on an inner surface of the cyclone body to collect fine contaminants, the fine contaminants being ionized by the corona discharge, wherein the cyclone body comprises:

a first cyclone chamber at a central portion of the cyclone body and at least one second cyclone chamber enclosing an outside of the first cyclone chamber;

a contaminant receptacle detachably engaged with a bottom end of the cyclone body to receive the contaminants discharged from the cyclone chambers;

a connection path guiding the drawn-in air discharged from the first cyclone chamber into the at least one second cyclone chamber; and a cover part covering an opened top end of the cyclone body to form a discharge path guiding the drawn-in air discharged from the at least one second cyclone chamber to an outside of the cyclone body, wherein the discharge electrode part is disposed in the at least one second cyclone chamber.

6. The device according to claim 5, wherein the fine contaminant collection part comprises a conductive paint sprayed on an inner surface of the cyclone body.

7. The device according to claim 5, wherein the fine contaminant collection part is formed over inner surfaces of the at least one second cyclone chamber and the cover part.

8. The device according to claim 7, further comprising:

a central air discharge opening guiding the drawn-in air discharged from the first cyclone chamber to the connection path; and a discharge needle having a top end connected with the power supply unit and a bottom end penetrating the central air discharge opening and disposed in the first cyclone chamber.

9. The device according to claim 8, further comprising:

a grille assembly disposed at the central air discharge opening to enclose the discharge needle; and a second fine contaminant collection part formed on an inner surface of the connection path.

10. The device according to claim 5, further comprising a second fine contaminant collection part formed on an inner surface of the first cyclone chamber.

* * * * *